US006795977B2

(12) United States Patent
Basson et al.

(10) Patent No.: US 6,795,977 B2
(45) Date of Patent: Sep. 28, 2004

(54) PROTECTIVE HELMET AND MEANS FOR CONNECTION OF AN ACCESSORY

(76) Inventors: Gilles Basson, La Grande Bévière, 01400 Chatillon sur Chalaronne (FR); Didier Schoepflin, Le Mollard d'en Bas, 01340 Marsonnas (FR)

( * ) Notice: Subject to any disclaimer, the term of this patent is extended or adjusted under 35 U.S.C. 154(b) by 40 days.

(21) Appl. No.: 10/031,318

(22) PCT Filed: May 21, 2001

(86) PCT No.: PCT/FR01/01554

§ 371 (c)(1),
(2), (4) Date: Apr. 12, 2002

(87) PCT Pub. No.: WO01/89332

PCT Pub. Date: Nov. 29, 2001

(65) Prior Publication Data

US 2002/0148032 A1 Oct. 17, 2002

(30) Foreign Application Priority Data

May 22, 2000 (FR) ..... 00 06869

(51) Int. Cl.[7] ..... A42B 1/24
(52) U.S. Cl. ..... 2/422; 2/6.3; 2/6.7; 2/424
(58) Field of Search ..... 2/9, 424, 422, 2/6.1, 6.2, 6.3, 6.4, 6.5, 6.6, 6.7

(56) References Cited

U.S. PATENT DOCUMENTS

| | | | | | |
|---|---|---|---|---|---|
| 3,315,272 | A | * | 4/1967 | Olt et al. | 2/424 |
| 3,491,371 | A | | 1/1970 | De Angelis | |
| 3,585,638 | A | * | 6/1971 | Aileo | 2/6.5 |
| 4,449,787 | A | | 5/1984 | Burbo et al. | |
| 4,457,461 | A | * | 7/1984 | Docking et al. | 2/422 |
| 4,918,752 | A | | 4/1990 | Briggs | |
| 4,922,550 | A | * | 5/1990 | Verona et al. | 2/6.2 |
| H000833 | H | * | 11/1990 | Brindle | 2/424 |
| 5,226,181 | A | * | 7/1993 | Polednak et al. | 2/422 |
| 5,265,276 | A | | 11/1993 | Kimberly, Jr. | |
| 5,341,512 | A | * | 8/1994 | Noble | 2/6.2 |
| 5,623,730 | A | * | 4/1997 | Baudou et al. | 2/6.2 |
| 5,813,048 | A | | 9/1998 | Thom | |
| 6,301,720 | B1 | * | 10/2001 | Bataille et al. | 2/422 |
| 6,622,313 | B1 | * | 9/2003 | Choi et al. | 2/424 |
| 2002/0020004 | A1 | * | 2/2002 | Beautz | 2/422 |

FOREIGN PATENT DOCUMENTS

| | | | | |
|---|---|---|---|---|
| DE | 9409463 | | 11/1995 | |
| DE | 19630921 | | 2/1997 | |
| EP | 0290293 | | 11/1988 | |
| EP | 0671132 | | 9/1995 | |
| FR | 2560753 | | 9/1985 | |
| FR | 2708427 | | 2/1995 | |
| GB | 2155762 | A * | 10/1985 | A42B/3/00 |

* cited by examiner

*Primary Examiner*—Rodney M. Lindsey
(74) *Attorney, Agent, or Firm*—Greenblum & Bernstein, P.L.C.

(57) ABSTRACT

Protective helmet includes a main outer shell having a generally vertical plane of symmetry. At least a first accessory is removably connected to the main outer shell. At least a second accessory is removably connected to the main outer shell. A connecting and locking system is included. When the first accessory is removed, the second accessory can be removably connected to the main outer shell via the connecting and locking system, and when the second accessory is removed, the second accessory can be removably connected to the main outer shell via the connecting and locking system.

41 Claims, 10 Drawing Sheets

PROTECTIVE HELMET AND MEANS FOR CONNECTION OF AN ACCESSORY

CROSS-REFERENCE TO RELATED APPLICATIONS

The present application is a National Stage Application of International Application No. PCT/FR/01/01554, filed May 21, 2001. Further, the present application claims priority under 35 U.S.C. § 119 of French Patent Application No. 0006869 filed on May 22, 2000.

BACKGROUND OF THE INVENTION

1. Field of the Invention

The present invention relates to an improvement to a protective helmet, and more particularly its system for connecting an accessory such as a support, for example, for example, for a night-vision device or the like, or even a protective screen.

2. Discussion of Background Information

Protective helmets are already known, which are used in various fields and worn by various users such as cyclists, motorcyclists, firefighters, skiers and others, such as aircraft or helicopter pilots. All of the currently available helmets, irrespective of their use, include a generally spherical rigid outer shell, having a facial opening, and whose cavity thus formed includes protective and comfort padding elements adapted to nest the user's head. Furthermore, the helmet is conventionally held on the user's head by a flexible chin strap fixed to the lateral portions of the helmet.

SUMMARY OF THE INVENTION

The present invention therefore proposes particularly simple and reliable detachable system for connecting an accessory to the helmet.

Thus, the protective helmet of the invention including a main outer shell with a generally vertical plane of symmetry on which an accessory, such as a clear or tinted visor or a support structure for optronic equipment such as a night-vision device, can be fixed, is characterized in that it includes connecting and locking system enabling the user to fix one or the other of the accessories to the helmet.

According to one complementary characteristic, the connecting and locking system includes mechanisms arranged on both sides of the shell and includes a hooking pin affixed to the shell of the helmet and a hooking and locking piece affixed to the accessory.

According to one embodiment, each of the pins extends outwardly on both sides of the corresponding lateral wall of the shell along a transverse axis.

Moreover, the bar includes a rearwardly open housing, whereas the lock is constituted by a hook-shaped metallic piece journalled on the bar about a pivoting axis, and whereas the lock includes a rear locking projection extending upwardly to form, together with the housing of the bar, a hole that is adapted to cooperate with the corresponding hooking pin of the shell.

According to one embodiment, the lock is pivotally arranged on its corresponding bar so as to be capable of pivoting downwardly against the action of the spring, and to be biased in upward abutment by this spring.

In a preferred embodiment of the invention, the support structure for a night-vision device includes a wall made of a composite material that has substantially the shape of a triangular sphere portion, whereas it includes an ocular protective screen pivotally movable about a transverse axis in relation to the shell between two positions, i.e., between an active lowered position of use according to which it is arranged in front of the user's eyes and an inactive raised position of non-use according to which it is raised so as to be in front of the frontal wall of the shell, the screen being guided in the center of the helmet by a guiding and locking carriage moving in a central slide. According to this embodiment, the wall of the support structure is arranged at the level of the front upper wall portion of the shell, beyond and at a certain distance from the latter so as to leave a space enabling the protective screen to move with its guiding carriage, whereas the wall of the support structure includes at least one hole enabling the user to have access to the guiding carriage of the ocular protective screen in order to be able to maneuver it, even in the presence of the night-vision device.

The invention provides for a protective helmet comprising a main outer shell having a generally vertical plane of symmetry. At least a first accessory is removably connected to the main outer shell. At least a second accessory is removably connected to the main outer shell. A connecting and locking system is included. When the first accessory is removed, the second accessory can be removably connected to the main outer shell via the connecting and locking system, and when the second accessory is removed, the second accessory can be removably connected to the main outer shell via the connecting and locking system.

At least one of the first and second accessories may comprise a clear visor, a tinted visor, and a support structure. At least one of the first and second accessories may comprise a support structure for an optronic device. The optronic device may comprise a night-vision device. Thus, only when the first accessory is removed can the second accessory be removably connected to the main outer shell via the connecting and locking system, and only when the second accessory is removed can the first accessory be removably connected to the main outer shell via the connecting and locking system. The connecting and locking system may comprise a first and second hooking pin arranged on sides of the main outer shell and first and second hooking and locking pieces arranged on the sides of each of the first and second accessories. The first and second hooking pins may be fixed to the main outer shell. The first and second hooking and locking pieces may be fixed to each of the first and second accessories. The first and second hooking pins may be arranged to extend outwardly on both sides of corresponding lateral walls of the main outer shell along a transverse axis. Each of the first and second hooking pins may be cylindrically shaped. Each of the first and second hooking pins may comprise a hooking groove adapted to cooperate with a corresponding hooking piece of the first and second accessories. The connecting and locking system may comprise hooking and locking pieces, each of the first and second accessories having two hooking and locking pieces. Each hooking and locking piece may comprise a metal bar. Each hooking and locking piece may comprise a lock device which is a least one of pivotally and movably mounted. The lock device may be biased by an elastic system. The elastic system may comprise a torsional spring. Each hooking and locking piece may comprise an open slot. The lock device may be connected to each hooking and locking piece via a journal. The lock device may comprise a locking projection. Each hooking and locking piece and each lock device may define an opening that is adapted to cooperate with a corresponding hooking pin. The hooking pin may be one of connected and fixed to the main outer shell. Each lock device may be pivoted downwardly against an action of a spring, and is biased upwardly by the spring. At least one of the first and second accessories may comprise a sem-spherical shaped wall made of a composite material. The sem-spherical shaped wall may have a substantially triangular shape. At least one of the first and second accessories may comprise an ocular protective screen. The ocular protective screen may be pivotally movable about a transverse axis with respect to the main outer shell between at least two positions. One of the at least two positions may be a lowered active position of use, whereby the ocular protective screen is arranged in front of a user's eyes, and another of the at least two positions may be a raised inactive position of use, whereby the ocular protective screen is arranged above a portion of the main outer shell. The ocular protective screen may be guided in a center of the helmet by a guiding and locking carriage. The guiding and locking carriage may be movable in central side. The central slide may be disposed on the main outer shell. At least one of the first and second accessories may comprise a support structure and may further comprise a protective screen. The protective helmet may further comprise a space arranged between the support structure and the protective screen. Each of the support structure and the protective screen may be movably mounted to the main outer shell. The protective screen may be arranged between the support structure and the main outer shell. The support structure may comprise at least one opening. At least one of the support structure and the protective screen may be connected to a guiding carriage. The support structure may comprise at least one opening. At least one of the first and second accessories may comprise a protective screen.

The invention also provides for a protective helmet comprising a main outer shell. A first support structure is adapted to be removably connected to the main outer shell. A second support structure is adapted to be removably connected to the main outer shell. A protective screen is movably mounted to the main outer shell. A connecting and locking system is provided. When the first support structure is removed, the second support structure can be removably connected to the main outer shell via the connecting and locking system, and when the second support structure is removed, the first support structure can be removably connected to the main outer shell via the connecting and locking system.

The invention also provides for a protective helmet comprising a main outer shell. A support structure is adapted to be removably connected to the main outer shell. A protective screen is adapted to be removably connected to the main outer shell. A connecting and locking system is provided. When the support structure is removed, the protective screen can be removably connected to the main outer shell via the connecting and locking system, and when the protective screen is removed, the support structure can be removably connected to the main outer shell via the connecting and locking system.

Other characteristics and advantages of the invention will become apparent from the description that follows, with reference to the annexed drawings which are only provided by way of non-limiting examples.

BRIEF DESCRIPTION OF THE DRAWINGS

FIG. 4 is a rear perspective view, and FIG. 5 is a front perspective view;

FIG. 6 is an outer lateral view, FIG. 7 is an end view, and FIG. 8 is an inner lateral view;

FIG. 23 shows an alternative support for a night-vision device;

FIG. 24 shows the helmet according to the invention with a detachable facial protective screen.

DETAILED DESCRIPTION OF THE INVENTION

Figure 1:
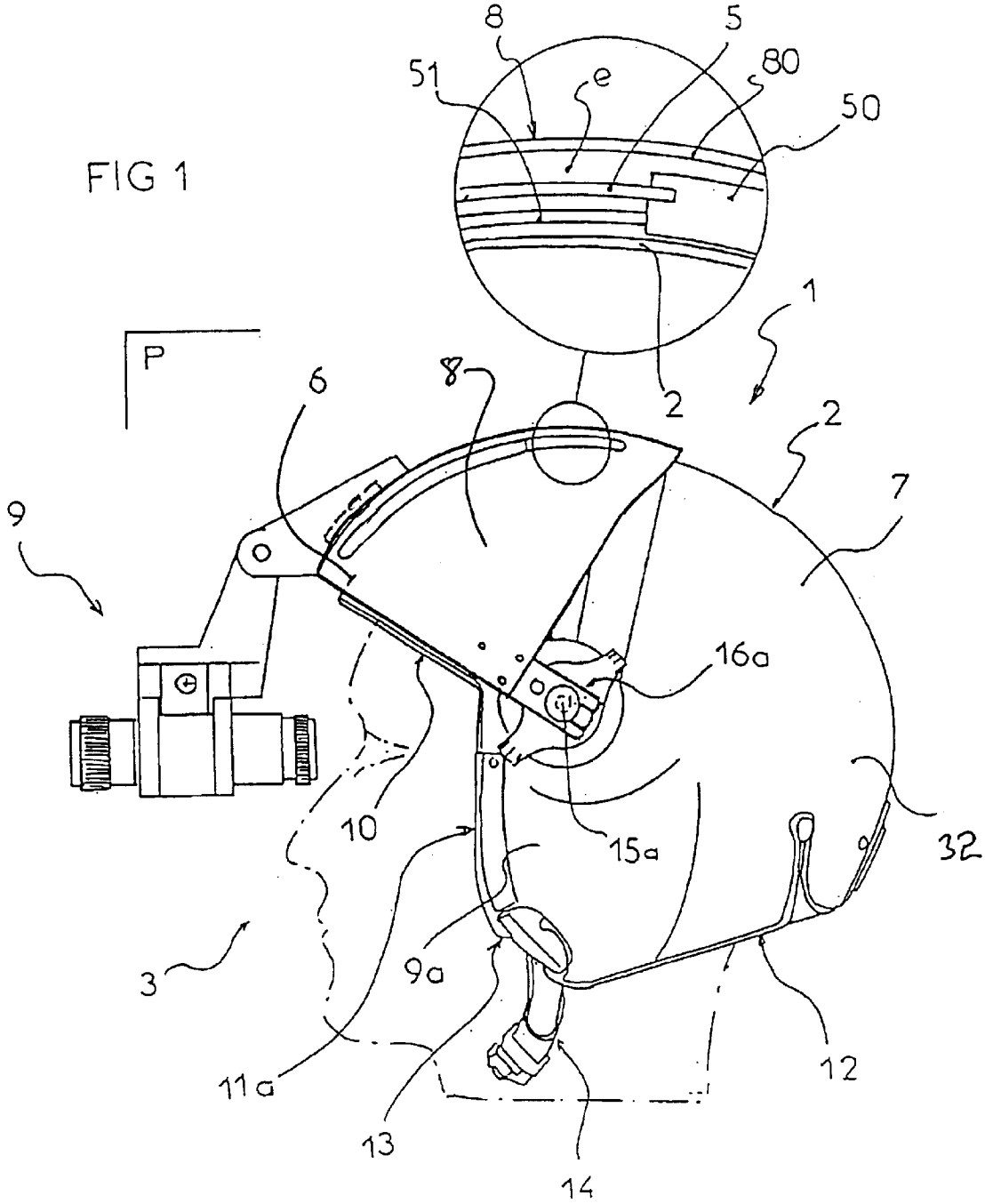
FIG. 1 is a lateral view, with a partial tear, showing the helmet according to the invention with one of its accessories, in particular, its support for a night-vision device.
Figure 2:
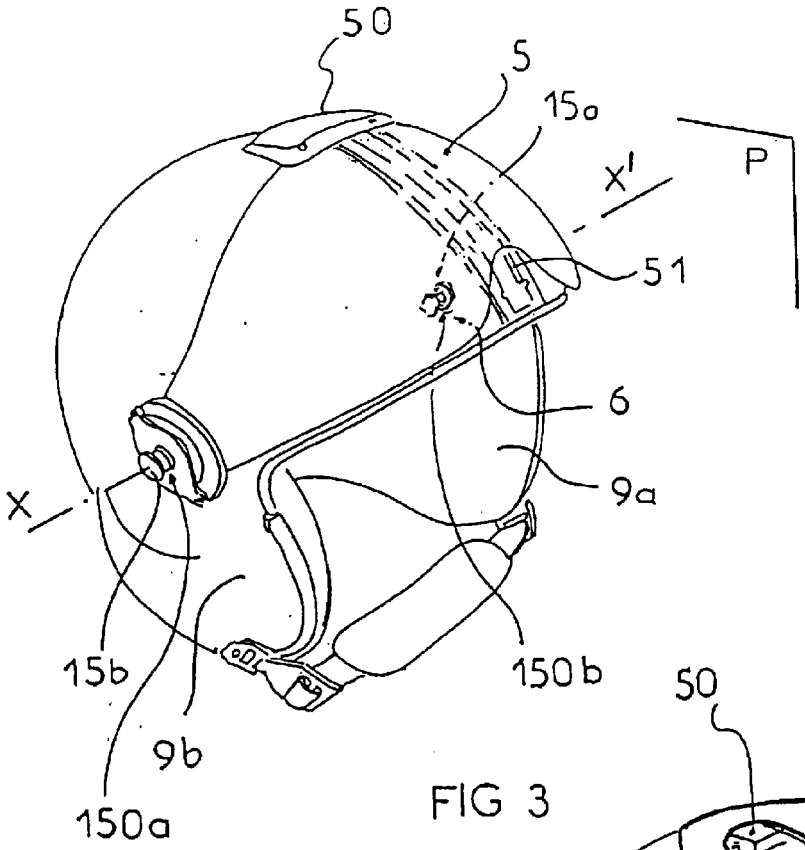
FIG. 2 is a perspective view of the helmet without its accessory.
Figure 3:
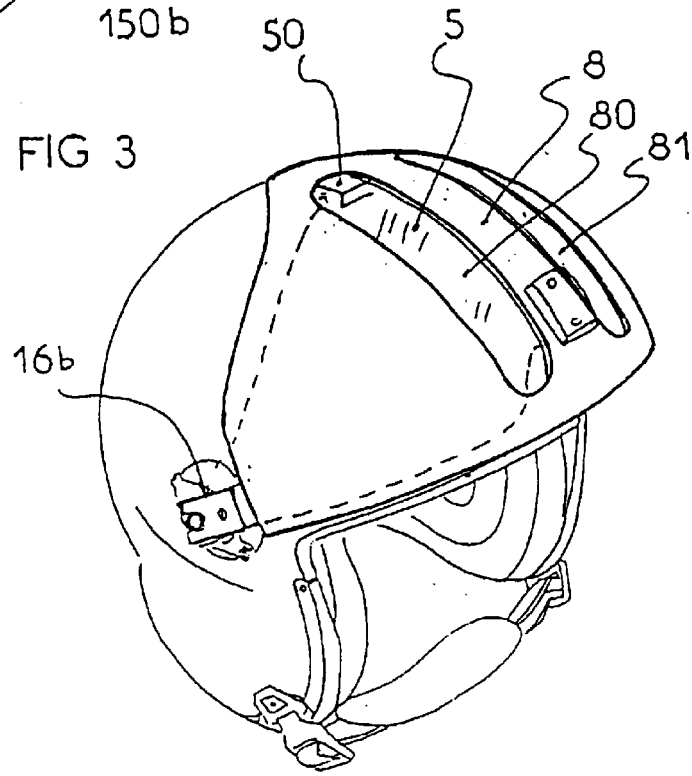
FIG. 3 is a perspective view of the helmet with its support for a night-vision device, the device not being shown.
Figure 4:
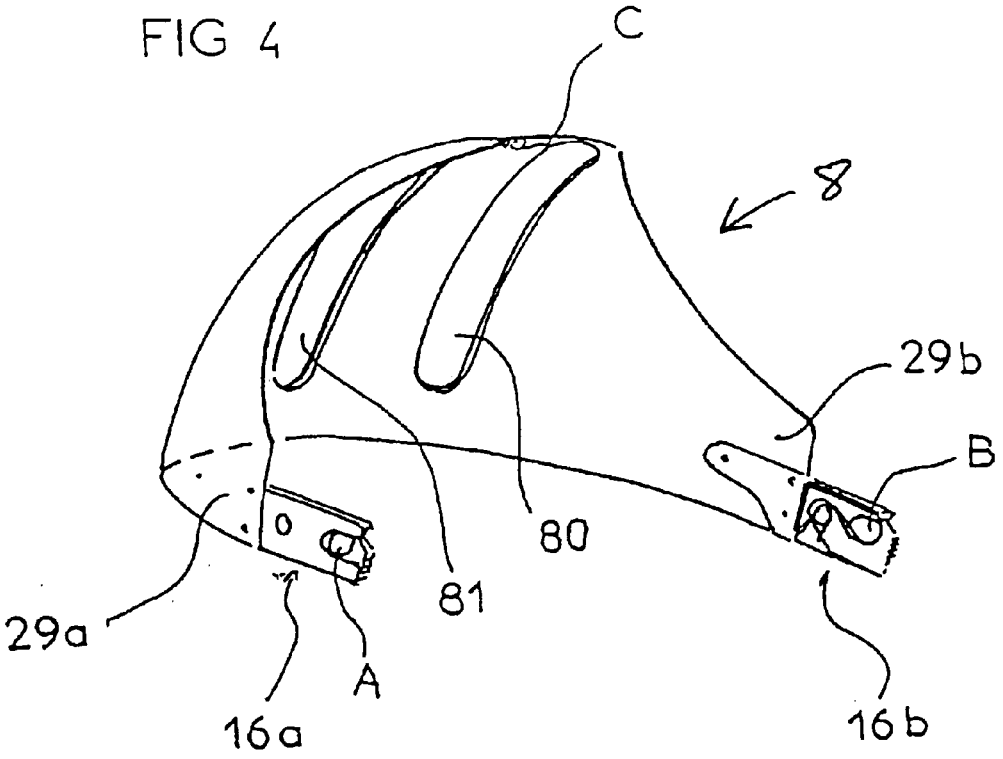
FIGS. 4 and 5 are views showing the supports for a night-vision device, with the system for connecting to the helmet.
Figure 5:
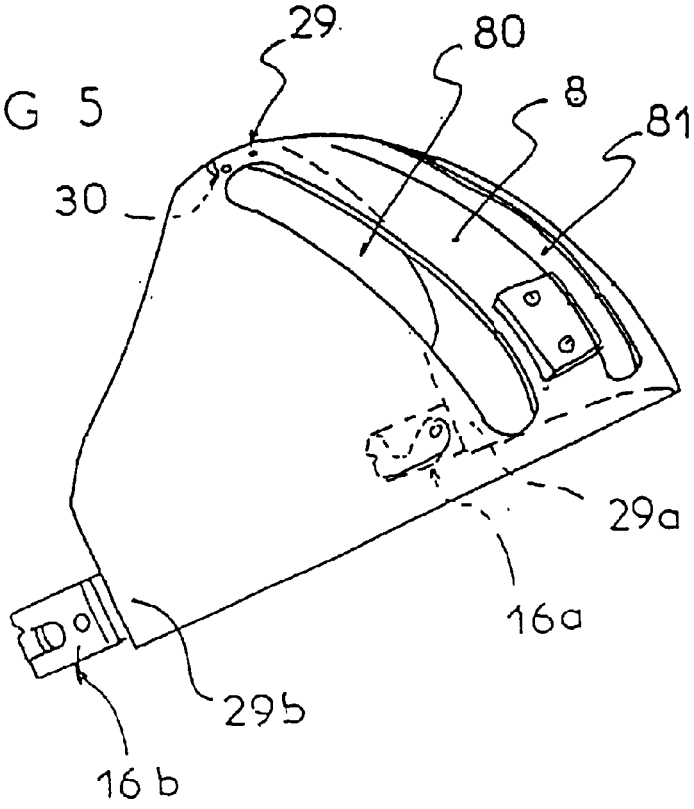
Figure 7:
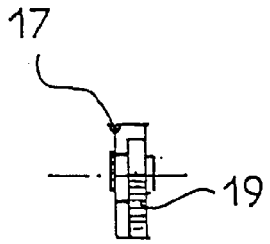
FIGS. 6, 7, and 8 are views showing the connecting system affixed to the accessory.
Figure 6:
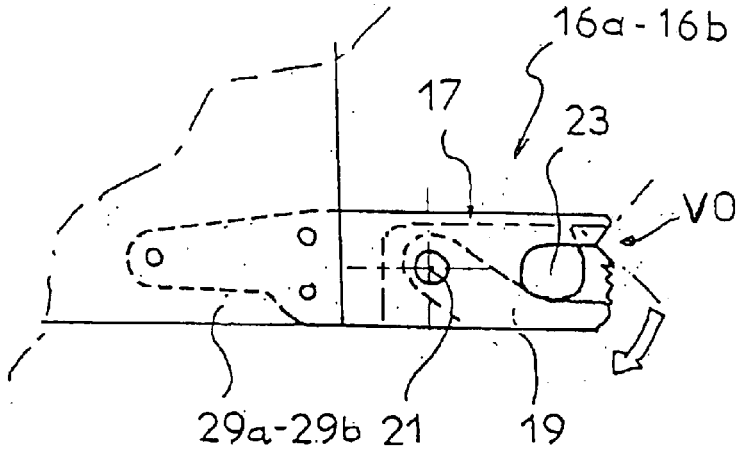
Figure 8:
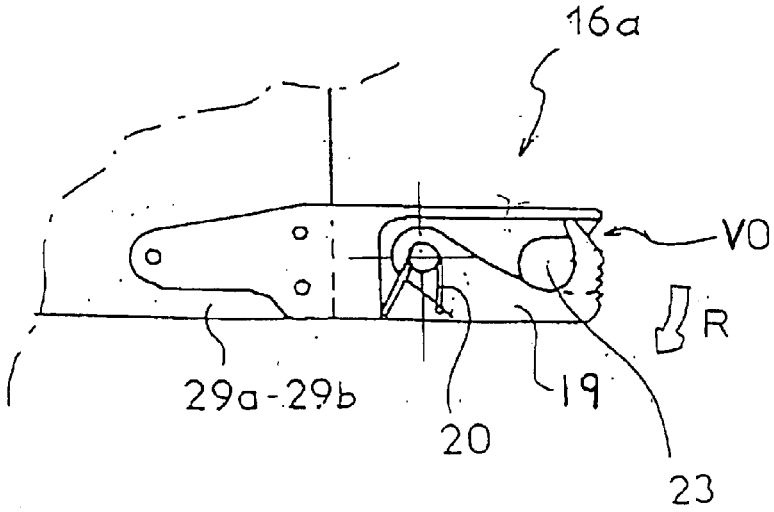
Figure 11:
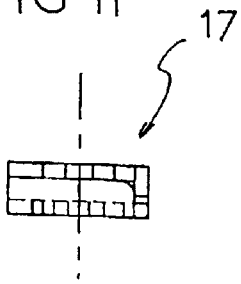
FIGS. 9, 10, and 11 are views showing the connecting bar without its lock.
Figure 10:
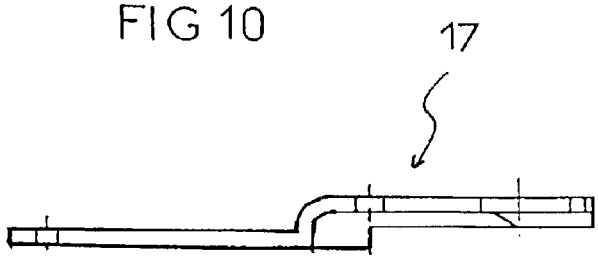
Figure 9:
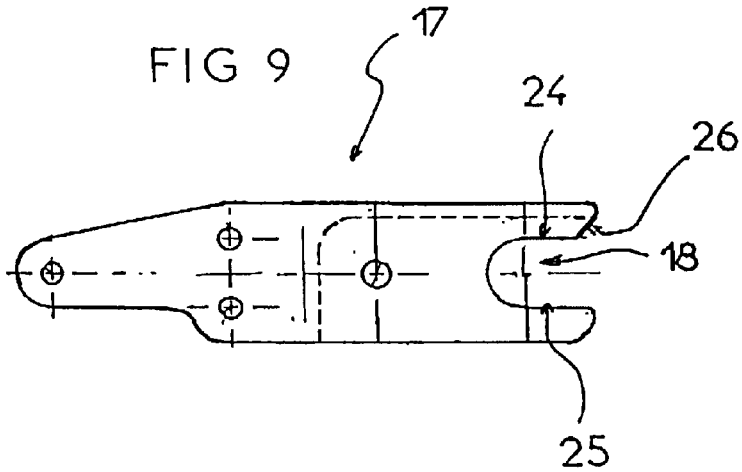
Figure 12:
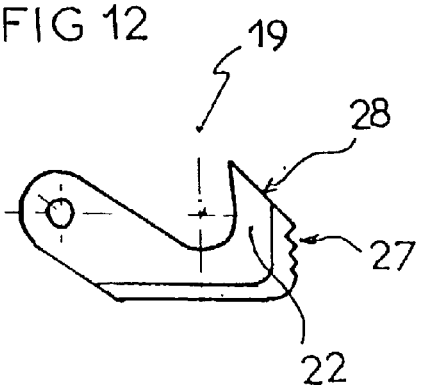
FIGS. 12, 13, and 14 are views showing the corresponding lock.
Figure 13:
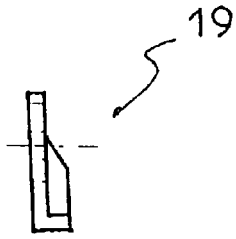
Figure 14:
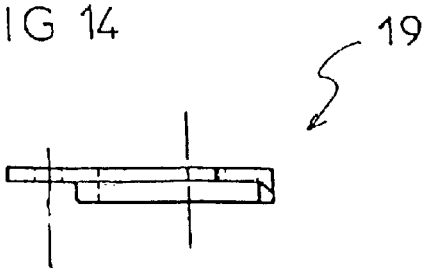

The protective helmet shown in FIGS. 1–24, generally designated by the reference numeral 1 is, for example, a helmet for aircraft or helicopter pilots having a generally longitudinal plane of symmetry P, which includes, in a known fashion, a main outer shell 2 having a front facial opening 2 with an internal padding commonly called the cap.

The main outer shell 2 is constituted by a substantially spherical wall, with a generally vertical plane of symmetry P, which is advantageously made of a composite material of the type including a stacking of layers of reinforcing fibers, impregnated and linked to one another by a resin matrix. The fibers can be glass, aramid, Nylon, polyethylene, or carbon fibers, whereas the matrix can be a thermosetting- or thermoplastic-type resin.

The main outer shell 2 includes a plurality of wall portions, namely, a front upper wall portion 6 extended rearwardly by a rear upper wall portion 7 itself extended downwardly by a rear lower wall portion 32, and further includes two lateral wall portions 9*a* and 9*b*. The front upper portion 6 corresponds to the zone occupied by the user's forehead and is limited by the upper edge 10 of the facial opening 3 which is limited laterally by two lateral edges 11*a* and 11*b*. The rear upper wall portion 7 corresponds to the zone occupied by the user's skull, whereas the rear lower wall portion 32 corresponds to the zone occupied by the user's nape of the neck. Moreover, the wall 32 of the cap is limited downwardly by a lower edge 12. The lateral wall portions 9*a* and 9*b* correspond to the zones occupied by the user's ears and are limited forwardly by the corresponding lateral edge 11*a* and 11*b* of the facial opening 3 and downwardly by the front ends of the lower edge 12. The connection between the lateral edges 11*a* and 11*b* and the lower edge 12 occurs along an advantageously curved connecting edges 13. The helmet 1 of the invention further includes a chin strap 14 constituted, for example, by a flexible strap.

Furthermore, the inner covering of the shell 2 is constituted by a cap made, for example, of a rigid foam covered with a comfort flexible foam layer and a fabric for the internal decoration of the helmet.

The helmet 1 according to the invention can include an ocular protective screen 5 pivotally movable about a transverse axis XX' in relation to the shell 2 between two positions, i.e., between a lowered active position of use according to which it is positioned in front of the user's eyes and a raised inactive position of non-use according to which it is raised so as to be in front of the frontal wall of the shell 2. The screen 5 is guided in the center of the helmet 1 by a guiding and locking carriage 50 moving in a central slide 51.

The helmet 1 according to the invention is adapted to receive an accessory such as, for example, a support structure 8 or 8' for a night-vision device 9 or a clear or tinted visor 8", for example.

According to one characteristic of the invention, the helmet 1 includes a connecting and locking system adapted to detachably fix one or the other of the accessories, depending on the user's needs.

Thus, according to one characteristic of the invention, connecting and locking mechanisms are provided between the helmet 1 and the accessory, which 8, 8' or 8", which enable the accessory to be reliably connected to the helmet 1 while allowing a particularly simple and voluntary detachment.

The support structure 8 of the night-vision device 9 is constituted by a wall made of a composite material that has substantially the shape of a triangular sphere portion.

It is noted that the wall of the support structure 8 is arranged at the level of the front upper wall portion 6 of the shell 2, beyond and at a certain distance from the latter so as to leave a space e enabling the protective screen 5 to move with its guiding carriage 50, as is particularly visible in FIG. 1. Furthermore, the support wall 8 includes at least one hole and advantageously two elongated holes or opening 80 and 81 enabling the user to have access to the guiding carriage 50 of the ocular protective screen 5, in order to be able to maneuver it even in the presence of the night-vision device 9.

The connecting and locking system includes hooking pins 15*a* and 15*b* affixed to the shell 2 of the helmet 1 and hooking and locking pieces 16*a* and 16*b* affixed to the accessory 8. Each of the pins 15*a* and 15*b* extends outwardly on both sides of the corresponding lateral walls 9*a* and 9*b* of the shell 2 and is advantageously arranged coaxially with respect to the transverse pivoting axis XX' of the ocular protective screen 5. In addition, each of the advantageously cylindrical pins 15*a* and 15*b* includes a hooking groove 150*a* and 150*b* adapted to cooperate with the corresponding hooking pieces 16*a* and 16*b* of the support wall 8.

Each hooking and locking piece 16*a* and 16*b* is constituted by a metallic bar 17 fixed to the support structure 8, 8' or 8", and includes a housing 18 open rearwardly and a pivotally movable lock 19 biased by an elastic system such as a torsional spring 20.

The lock 19 is constituted by a hook-shaped metallic piece journalled on the hooking bar 17 about a pivoting axle 21. Each lock 19 therefore includes a rear locking projection 22 extending upwardly to form, together with the housing 18 of the bar 17, a hole 23 adapted to cooperate with the corresponding hooking pins 15*a* and 15*b* of the shell 2.

It is noted that the housing 18 of the bar 17 is limited upwardly and downwardly by an upper edge 24 and a lower edge 25, the end of the upper edge 24 including a first chamfer 26. Furthermore, the rear edge 27 of the locking projection 22 includes a second chamfer 28 adapted to form, together with the first chamfer 26 of the bar, a V-shaped opening VO for engaging the hooking pins 15*a* and 15*b* of the helmet 1, promoting the snap positioning of the support 8 or 8'. The lock 19 is pivotally arranged on its corresponding bar 17 so as to be capable of pivoting downwardly along direction R against the action of the spring 20, and be biased in upward abutment by this spring 20.

The support 8 of the night-vision device 9 is such that its triangular wall carries a hooking piece 16*a*, 16*b* at each of its lateral ends 29*a* and 29*b*, whereas its central upper end 29 includes a hooking mechanism 16 adapted to cooperate with a central upper hooking piece 31 fixed to the wall of the shell 2 of the helmet 1. Thus, the support 8 of the night-vision device 9 is fixed to the helmet 1 at three points, i.e., at points A, B and C, thus forming a perfect retention triangle.

Figure 15:
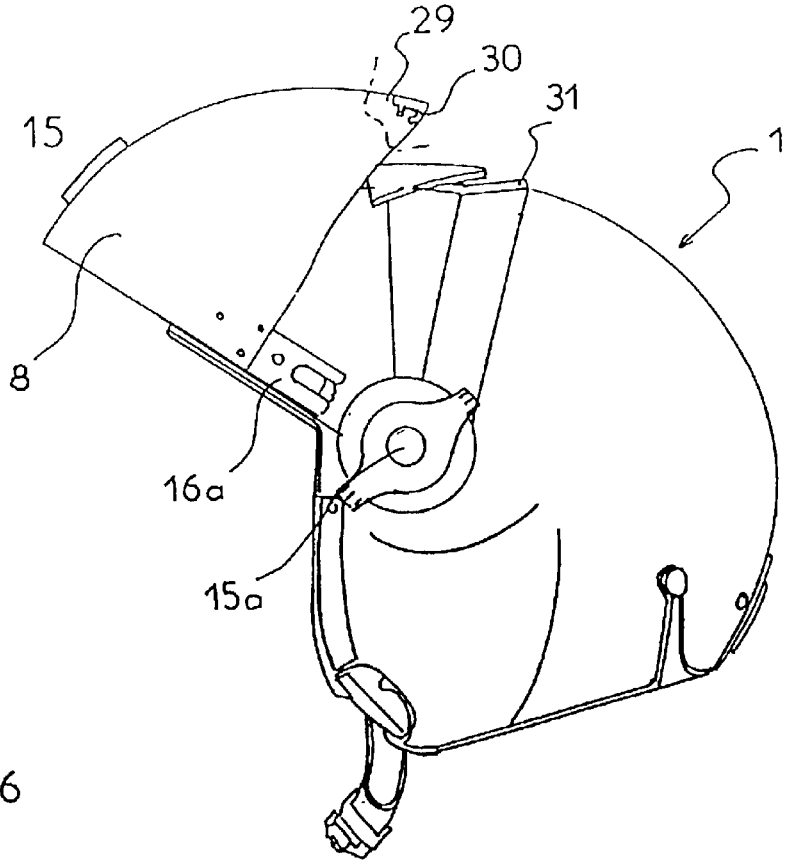
FIGS. 15, 16, and 17 show the various steps in fixing the support.
Figure 16:
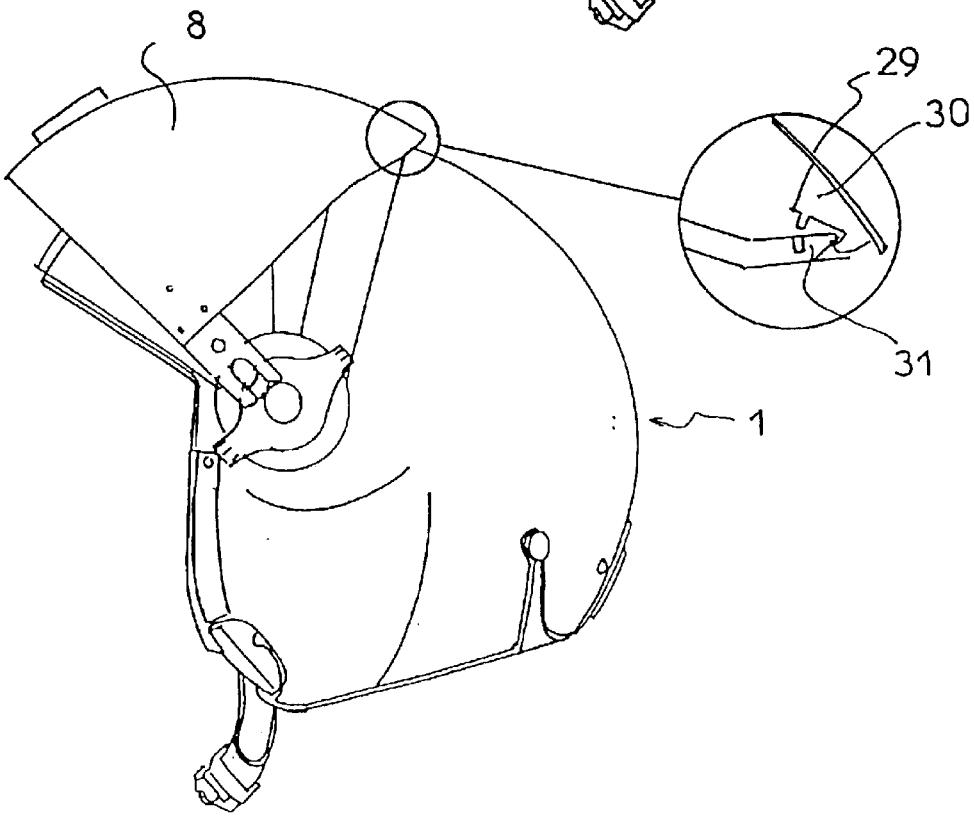
Figure 17:
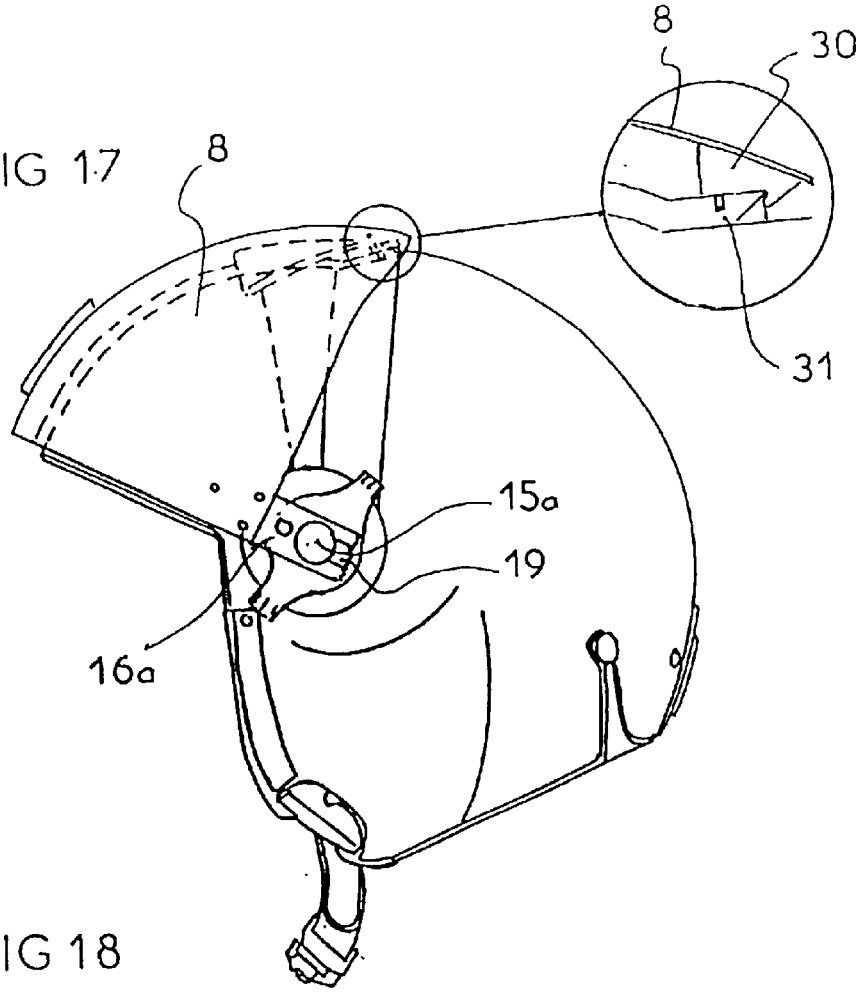
Figure 18:
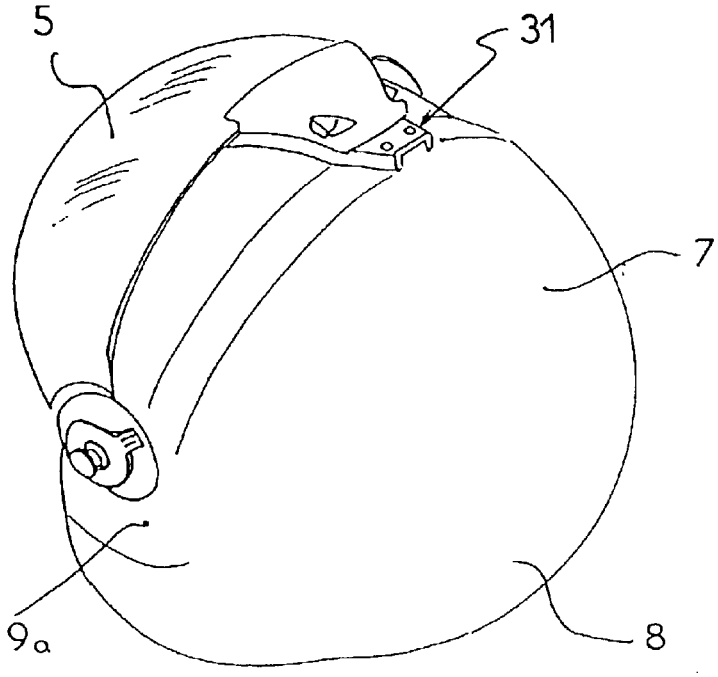
FIG. 18 is a rear perspective view showing how the third point for connecting the support to the helmet is obtained.
Figure 19:
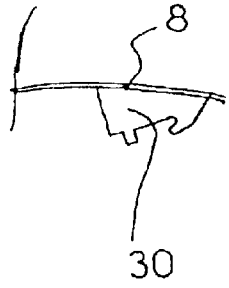
FIG. 19 showing the corresponding connecting portion of the support.

FIGS. 15, 16 and 17 illustrate the procedure for fixing the support wall 8. The procedure begins by bringing the wall support 8 closer to the helmet 1 (see FIG. 15), then by hooking the hooking mechanism 30 of the upper central end 29 on the upper central hooking piece 31 as shown in FIG. 16, and then by snap engaging the hooking pieces 16*a* and 16*b* on the corresponding pins 15*a* and 15*b* (see FIG. 17).

Figure 20:
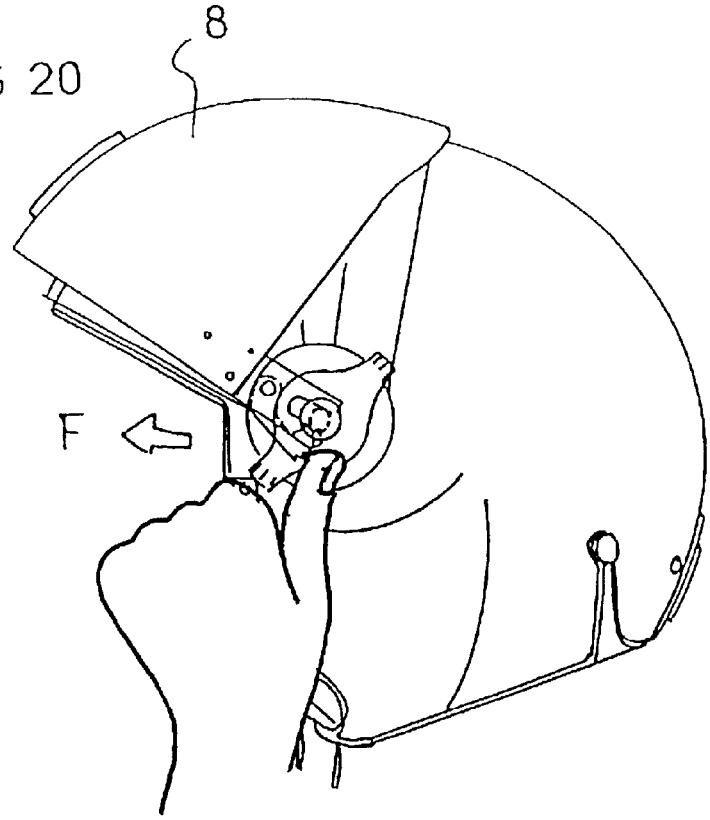
FIGS. 20–22 show the various steps in releasing the support.
Figure 21:
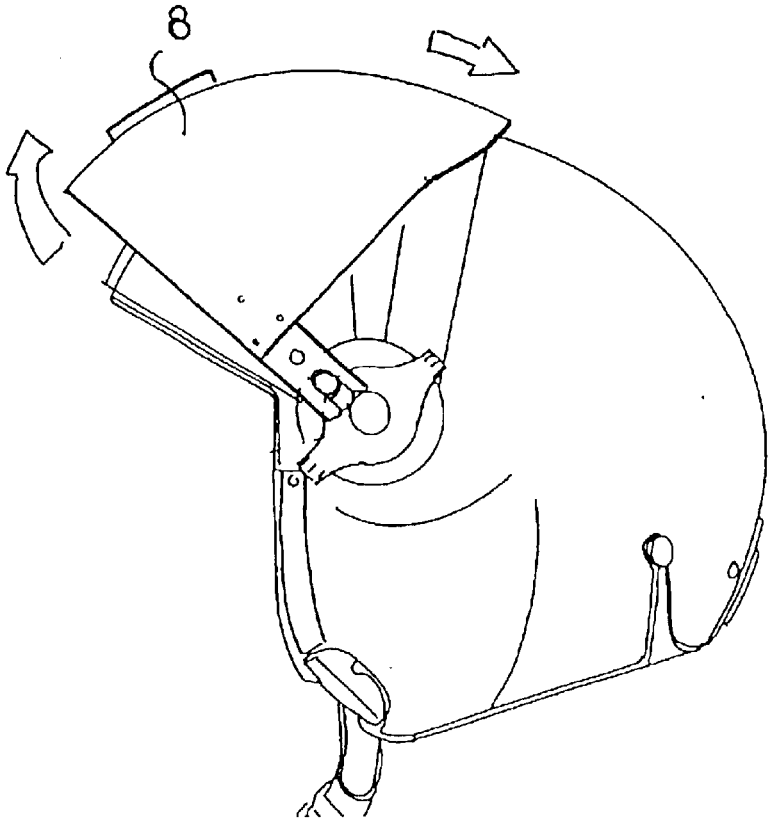
Figure 22:
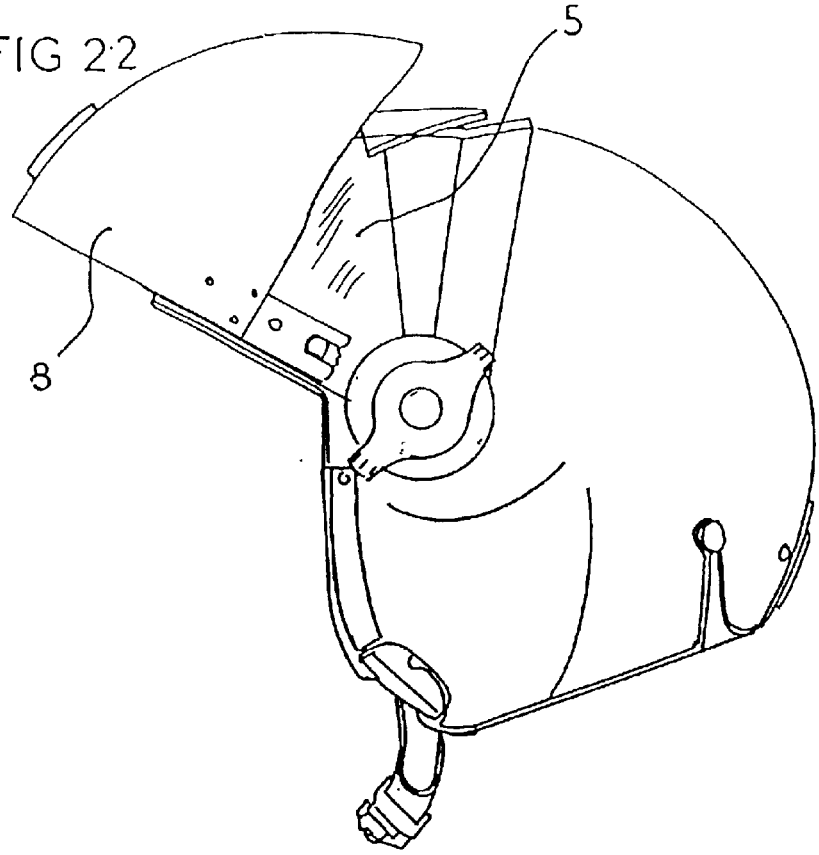

The separation of the support 8 from the helmet 1 is carried out just as easily, as illustrated in FIGS. 20, 21, 22. To unlock, the user only has to press forwardly, along F, on each of the movable locks 19 with his two thumbs engaging rear edges 27, as shown in FIG. 20. This causes the downward pivoting of each of the locks 19, on the one hand, and the forward pivoting of the support 8, and results, therefore, in its disengagement from the pins 15*a* and 15*b*.

Of course, the device carried by the support 8 can be of any type other than a device which supports the night-vision device 9, such as an assembly of optronic devices, binoculars, or the like, for example.

Figure 23:
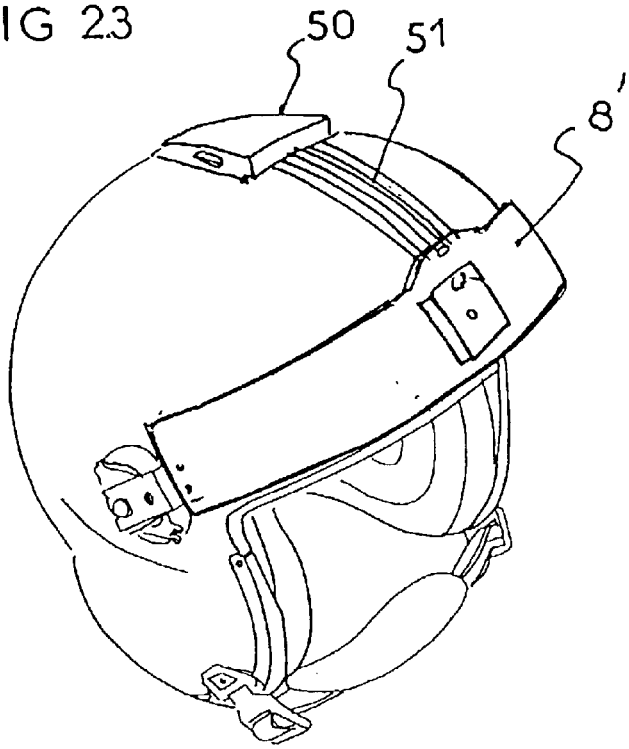
FIGS. 23 and 24 show two types of possible accessories that can be detachably connected to the helmet.

It is noted that the support 8 previously described and illustrated in FIGS. 1–22 is constituted by a substantially rectangular spherical wall 8, but it could be otherwise, as shown in FIG. 23, for example. According to this alternative, the support 8 is constituted by a frontal band 8'.

Figure 24:
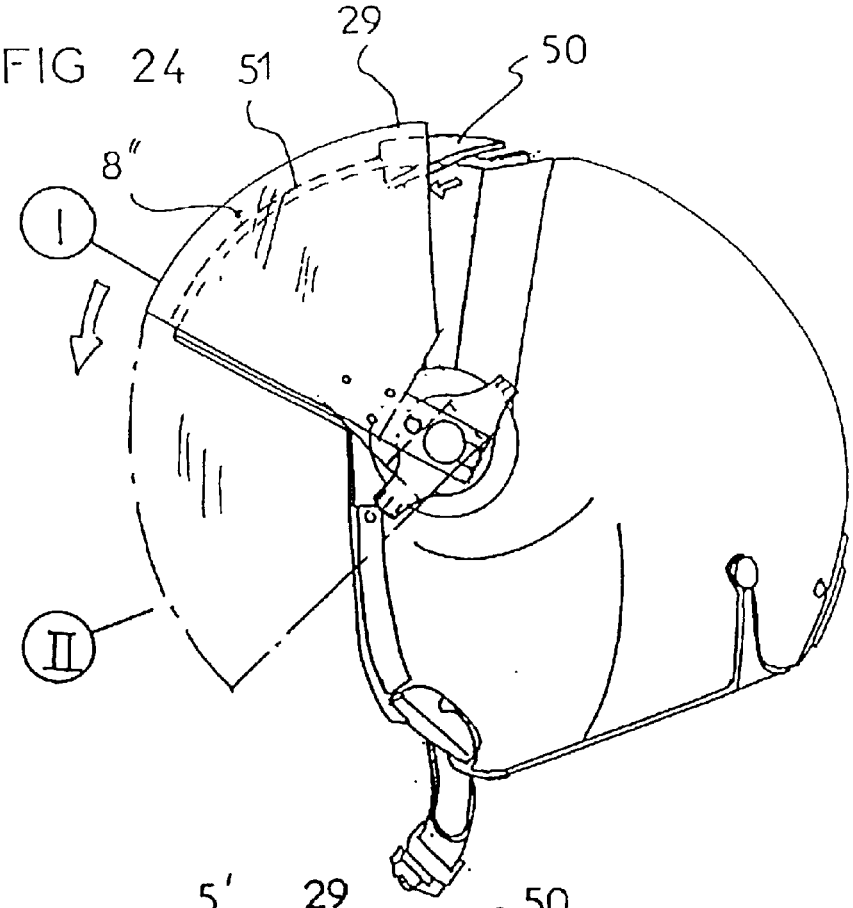

In addition, the detachable accessory can also be a clear or tinted transparent facial protective screen 8" as shown in FIG. 24, without leaving the scope of the invention, the screen 8" being detachable and pivotal about each of the pins 15*a* and 15*b* so as to be movable between two positions, namely, an inactive raised position designated by I and a lowered position of use designated by II. The detachable facial screen 8" is therefore connected laterally to the hooking pins 15*a* and 15*b* and in its upper central portion 29 to the guiding carriage 50; of course, the connection to the carriage 50 is also detachable and can be, for example, as that described previously in connection with the embodiments shown in FIGS. 15–19.

Figure 25:
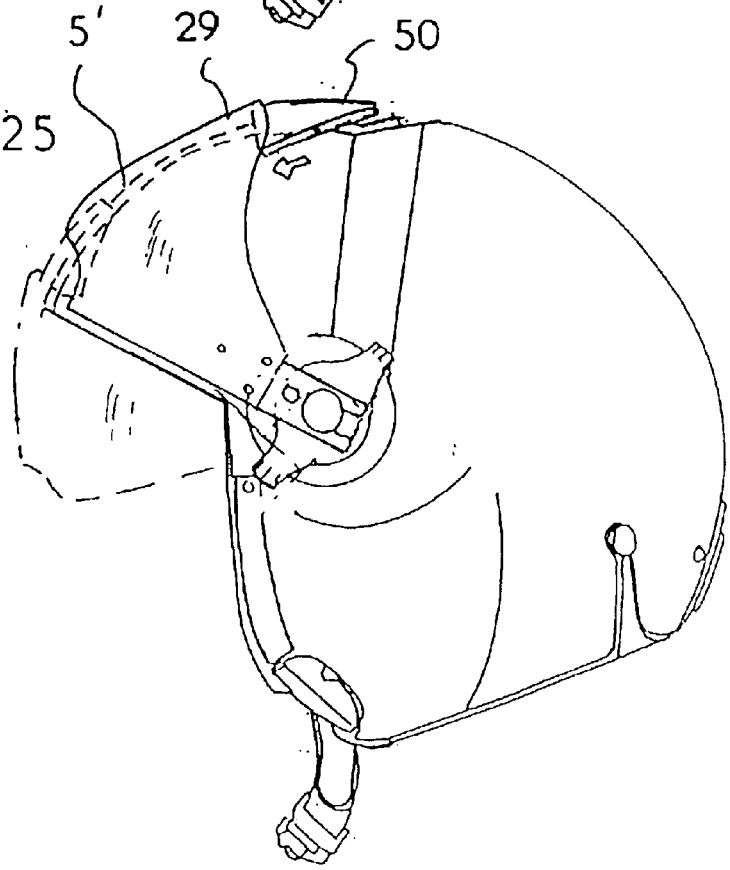
FIG. 25 shows the helmet of the invention with a detachable ocular protective screen.

The accessory can also be a detachable ocular screen 5', as shown in FIG. 25, the connection to the helmet 1 being identical to that of the facial screen described with regard to FIG. 24.

It is understood that due to the connection interface devices 15*a*, 15*b*, 16*a* and 16*b*, it is possible for the user to detachably fix an accessory and to remove it in order to fix another to the helmet 1.

What is claimed is:

1. A protective helmet comprising:

a main outer shell having generally vertical plane of symmetry;

at least a first accessory being removably connected to the main outer shell;

at least a second accessory being removably connected to the main outer shell; and a connecting and locking system comprising hooking pins arranged on the main outer shell and locking pieces arranged on each of the first and second accessories.

wherein, when the locking pieces detachably engaged and receive the hooking pins, wherein, when the first accessory is removed, the second accessory can be removably connected to the main outer shell via the connecting and locking system, and wherein, when the second accessory is removed, the first accessory can be removably connected to the main outer shell via the and locking system.

2. The protective helmet of claim 1, wherein at least one of the first and second accessories comprises a clear visor, a tinted visor, and a support structure.

3. The protective helmet of claim 1, wherein at least one of the first and second accessories comprises a support structure for an optronic device.

4. The protective helmet of claim 3, wherein the optronic device comprises a night-vision device.

5. The protective helmet of claim 1, wherein, only when the first accessory is removed can the second accessory be removably connected to the main outer shell via the connecting and locking system, and wherein, only when the second accessory is removed can the first accessory be removably connected to the main outer shell via the connecting and locking system.

6. The protective helmet of claim 1, wherein the hooking pins comprises first and second hooking pins arranged on sides of the main outer shell and wherein the locking pieces comprise first and second hooking and locking pieces arranged on sides of each of the first and second accessories.

7. The protective helmet of claim 6, wherein the first and second hooking pins are fixed to the main outer shell.

8. The protective helmet of claim 6, wherein the first and second hooking and locking pieces are fixed to each of the first and second accessories.

9. The protective helmet of claim 6, wherein the first and second hooking pins are arranged to extend outwardly on both sides of corresponding lateral walls of the main outer shell along a transverse axis.

10. The protective helmet of claim 6, wherein each of the first and second hooking pins are cylindrically shaped.

11. The protective helmet of claim 6, wherein each of the first and second hooking pins comprise a hooking groove adapted to cooperate with a corresponding hooking piece of each of the first and second accessories.

12. The protective helmet of claim 1, wherein each of the first and second accessories have two locking pieces which each comprise a hooking and locking piece.

13. The protective helmet of claim 12, wherein each hooking and locking piece comprises a metal bar.

14. The protective helmet of claim 12, wherein each hooking and locking piece comprises a lock device which is at least one of pivotally and movably mounted.

15. The protective helmet of claim 14, wherein the lock device is biased by an elastic system.

16. The protective helmet of claim 14, wherein each hooking and locking piece comprises an open slot.

17. The protective helmet of claim 14, wherein the each lock device is connected to each hooking and locking piece via a journal.

18. The protective helmet of claim 14, wherein the lock device comprises a locking projection.

19. The protective helmet of claim 1, wherein at least one of the first and second accessories comprises a semi-spherical shaped wall made of a composite material.

20. The protective helmet of claim 19, wherein the semi-spherical shaped wall has a substantially triangular shape.

21. The protective helmet of claim 1, wherein at least one of the first and second accessories comprises an ocular protective screen.

22. The protective helmet of claim 21, wherein the ocular protective screen is pivotally movable about a transverse axis with respect to the main outer shell between at least two positions.

23. The protective helmet of claim 22, wherein one of the at least two positions is a lowered active position of use, whereby the ocular protective screen is arranged in front of a user's eyes, and wherein another of the at least two positions is a raised inactive position of use, whereby the ocular protective screen is arranged above a portion of the main outer shell.

24. The protective helmet of claim 23, wherein the ocular protective screen is guided in a center of the helmet by a guiding and locking carriage.

25. The protective helmet of claim 24, wherein the guiding and locking carriage is movable in a central slide.

26. The protective helmet of claim 25, wherein the central slide is disposed on the main outer shell.

27. The protective helmet of claim 1, wherein at least one of the first and second accessories comprises a support structure and further comprising a protective screen.

28. The protective helmet of claim 27, further comprising a space arranged between the support structure and the protective screen.

29. The protective helmet of claim 28, wherein each of the support structure and the protective screen are movably mounted to the main outer shell.

30. The protective helmet of claim 28, wherein the protective screen is arranged between the support structure and the main outer shell.

31. The protective helmet of claim 30, wherein the support structure comprises at least one opening.

32. The protective helmet of claim 28, wherein at least one of the support structure and the projective screen is connected to a guiding carriage.

33. The protective helmet of claim 28, wherein the support structure comprises at least one opening.

34. The protective helmet of claim 1, wherein at least one of the first and second accessories comprises a protective screen.

35. A protective helmet comprising:

a main outer shell having a generally vertical plane of symmetry;

at least a first accessory being removably connected to the main outer shell;

at least a second accessory being removably connected to the main outer shell; and a connecting and locking system, wherein, when the first accessory is removed, the second accessory can be removably connected to the main outer shell via the connecting and locking system, and wherein, when the second accessory is removed, the second accessory can be removably connected to the main outer shell via the connecting and locking system, wherein the connecting and locking system comprises hooking and locking pieces, each of the first and second accessories having two hooking and locking pieces, wherein each hooking and locking piece comprises a lock device which is at least one of pivotally and movably mounted, wherein the lock device biased by an elastic system, and wherein the elastic system comprises a torsional spring.

36. A protective helmet comprising:

a main outer shell having a generally vertical plane of symmetry;

at least a first accessory being removably connected to the main outer shell;

at least a second accessory being removably connected to the main outer shell; and a connecting and locking system, wherein, when the first accessory is removed, the second accessory can be removably connected to the main outer shell via the connecting and locking system, and wherein, when the second accessory is removed, the second accessory can be removably connected to the main outer shell via the connecting and locking system, wherein the connecting and locking system comprises hooking and locking pieces, each of the first and second accessories having two hooking and locking pieces, wherein each hooking and locking piece comprises a lock device which is at least one of pivotally and movably mounted, wherein the lock device comprises a locking projection, and wherein each hooking and locking piece and each lock device define an opening that is adapted to cooperate with a corresponding hooking pin.

37. The protective helmet of claim 36, wherein each hooking pin is one of connected and fixed to the main outer shell.

38. A protective helmet comprising:

a main outer shell having a generally vertical plane of symmetry;

at least a first accessory being removably connected to the main outer shell;

at least a second accessory being removably connected to the main outer shell; and a connecting and locking system, wherein, when the first accessory is removed, the second accessory can be removably connected to the main outer shell via the connecting and locking system, and wherein, when the second accessory is removed, the second accessory can be removably connected to the main outer shell via the connecting and locking system.

wherein the connecting and locking system comprises hooking and locking pieces, each of the first and second accessories having two hooking and locking pieces, wherein each hooking and locking piece comprises a lock device which is at least one of pivotally and movably mounted, and wherein each lock device is pivoted downwardly against an action of a spring, and is biased upwardly by the spring.

39. A protective helmet comprising:

a main outer shell;

a first support structure adapted to be removably connected to the main outer shell;

a second support structure adapted to be removably connected to the main outer shell;

a protective screen movably mounted to the main outer shell; and a connecting and locking system comprising hooking pins arranged on the main outer shell and locking pieces arranged on each of the first and second support structures, wherein the locking pieces detachably engage and receive the hooking pins, wherein, when the first support structure is removed, the second support structure is adapted to be removably connected to the main outer shell via the connecting and locking system, and wherein, when the second support structure is removed, the first support structure is adapted to be removably connected to the main outer shell via the connecting and locking system.

40. A protective helmet comprising:

a main outer shell;

a support structure adapted to be removably connected to the main outer shell;

a protective screen adapted to be removably connected to the main outer shell; and a connecting and locking system comprising hooking pins arranged on the main outer shell and locking pieces arranged on each of the support structure and the protective screen, wherein the locking pieces detachably engage and receive the booking pins, wherein, when the support structure is removed, the protective screen is adapted to be removably connected to the main outer shell via the connecting and locking system, and wherein, when the protective screen is removed, the support structure is adapted to be removably connected to the main outer shell via the connecting and locking system.

41. A protective helmet comprising:

a main outer shell having generally vertical plane of symmetry;

at least one accessory removably connected to the main outer shell via a connection and locking system;

the connecting and locking system comprising:

first and second hooking pins arranged on the main outer shell; and first and second connecting devices arranged on the at least one accessory, the first connecting device comprising a first hooking member and a movably mounted first locking member;

the second connecting device comprising a second hooking member and a movably mounted second locking member;

the first hooking member and the movably mounted first locking member engaging an outer surface of the first hooking pin when the first connecting device is locked to the first hooking pin; and the second hooking member and the movably mounted second locking member engaging an outer surface of the second hooking pin when the second connecting device is locked to the second hooking pin.

* * * * *